US009476609B2

(12) United States Patent
Galus et al.

(10) Patent No.: US 9,476,609 B2
(45) Date of Patent: Oct. 25, 2016

(54) WATER SEPARATOR AND SYSTEM

(75) Inventors: Timothy J Galus, Hamburg, NY (US); John Stromecki, Hamburg, NY (US); Timothy Beechler, Java Center, NY (US)

(73) Assignee: API Heat Transfer Inc., Buffalo, NY (US)

( * ) Notice: Subject to any disclaimer, the term of this patent is extended or adjusted under 35 U.S.C. 154(b) by 1106 days.

(21) Appl. No.: 13/001,904

(22) PCT Filed: Dec. 7, 2009

(86) PCT No.: PCT/US2009/066975

§ 371 (c)(1),
(2), (4) Date: Dec. 29, 2010

(87) PCT Pub. No.: WO2010/128993

PCT Pub. Date: Nov. 11, 2010

(65) Prior Publication Data

US 2011/0100594 A1 May 5, 2011

Related U.S. Application Data

(60) Provisional application No. 61/176,071, filed on May 6, 2009.

(51) Int. Cl.
*F25D 17/06* (2006.01)
*F25D 21/14* (2006.01)
(Continued)

(52) U.S. Cl.
CPC ..... *F24F 13/222* (2013.01); *F24F 2003/1446* (2013.01)

(58) Field of Classification Search
CPC ..... F25D 17/06; F25D 21/14; F25D 21/00; B01D 53/002; F24F 7/00; F24F 3/14; F28D 5/00
USPC ..... 62/285, 272, 291, 93, 90, 317; 165/111, 165/113, 54, 55, 56, 110, 115, 116, 59, 60, 165/114, 166
See application file for complete search history.

(56) References Cited

U.S. PATENT DOCUMENTS 2,380,386 A * 7/1945 Crawford ..... 62/87
2,632,315 A 3/1953 Coblentz
(Continued)

FOREIGN PATENT DOCUMENTS

CN 2813390 Y 9/2006
JP 2002181464 A 6/2002
(Continued)

OTHER PUBLICATIONS

ISA/KR, International Search Report and Written Opinion for PCT/US2009/066975, Jul. 20, 2010.
(Continued)

*Primary Examiner* — Travis Ruby
*Assistant Examiner* — Harry Arant
(74) *Attorney, Agent, or Firm* — Phillips Lytle LLP; David L. Principe

(57) ABSTRACT

A water separator and system includes a compressed air aftercooler and water/moisture separator with a demister core comprising a plurality of offset fins. In one embodiment, the compressed air aftercooler comprises a compressed air core having an aftercooler inlet, an aftercooler outlet at the bottom of the compressed air core, and one or more heat transfer passages. In one aspect, the system comprises a moisture separator substantially integral to the aftercooler. In another aspect, the system includes a first generally horizontal region beneath and adjacent to the aftercooler outlet; and an expansion zone adjacent to and in fluid communication with the first region, the expansion zone being configured to reduce the horizontal velocity of compressed air passing therethrough. In another aspect, the demister core is in fluid communication with the expansion zone. In certain aspects, the demister core comprises a plurality of offset fins creating an undulating/uneven flow and/or creating air flow direction change. Another aspect includes an exit zone downstream from the demister core, wherein the exit zone has a compressed air outlet and a condensate drain.

20 Claims, 8 Drawing Sheets

(51) Int. Cl.
*F24F 13/22* (2006.01)
*F24F 3/14* (2006.01)

(56) References Cited

U.S. PATENT DOCUMENTS

| | | | | | |
|---|---|---|---|---|---|
| 2,935,856 | A | | 5/1960 | Gifford | |
| 3,541,807 | A | | 11/1970 | Henderson | |
| 3,585,808 | A | | 6/1971 | Huffman | |
| 3,797,565 | A | | 3/1974 | Fernandes | |
| 4,193,443 | A | * | 3/1980 | Nanaumi et al. | 165/66 |
| 4,235,081 | A | | 11/1980 | Dowling | |
| 4,237,696 | A | | 12/1980 | Coblentz | |
| 4,242,110 | A | | 12/1980 | Hynes | |
| 4,359,879 | A | | 11/1982 | Wright | |
| 4,410,035 | A | | 10/1983 | White | |
| 4,487,618 | A | * | 12/1984 | Mann | 55/323 |
| 4,600,416 | A | * | 7/1986 | Mann | 55/323 |
| 4,627,406 | A | * | 12/1986 | Namiki et al. | 123/573 |
| 5,047,786 | A | * | 9/1991 | Levy | 392/370 |
| 5,107,919 | A | | 4/1992 | Basseen et al. | |
| 5,228,504 | A | | 7/1993 | Mantegazza et al. | |
| 5,275,233 | A | * | 1/1994 | Little | 165/111 |
| 5,299,633 | A | | 4/1994 | Bruggemann et al. | |
| 5,765,631 | A | * | 6/1998 | Gerard | 165/166 |
| 5,845,505 | A | * | 12/1998 | Galus et al. | 62/95 |
| 5,888,259 | A | * | 3/1999 | Maeda | 55/323 |
| 6,085,529 | A | * | 7/2000 | Galus et al. | 62/93 |
| 6,766,655 | B1 | * | 7/2004 | Wu | 62/305 |
| 6,973,805 | B2 | * | 12/2005 | Higashiyama | 62/525 |
| 7,121,102 | B2 | * | 10/2006 | Fijas et al. | 62/93 |
| 7,954,542 | B2 | * | 6/2011 | Janssens | 165/114 |
| 2001/0035092 | A1 | | 11/2001 | Hachimaki et al. | |

FOREIGN PATENT DOCUMENTS

| | | | |
|---|---|---|---|
| JP | 2005279486 | A | 10/2005 |
| WO | 2005/075057 | A1 | 8/2005 |

OTHER PUBLICATIONS

ISA/KR, International Preliminary Report on Patentability for PCT/US2009/066975, Nov. 9, 2011.

* cited by examiner

WATER SEPARATOR AND SYSTEM

RELATED APPLICATIONS

This is the U.S. National Stage application of International Application No. PCT/US2009/066975, filed Dec. 7, 2009, which claims priority to U.S. Provisional Patent Application No. 61/176,071, filed May 6, 2009, both incorporated herein by reference.

BACKGROUND OF THE INVENTION

When humid ambient air is compressed in an air compressor, thermodynamic processes occur that raise the air temperature and the dew point temperature. The dew point temperature as used herein is the temperature at which the relative humidity becomes 100% saturated and water vapor in the compressed air begins to condense into liquid.

The temperature increase can be significant enough to make the compressed air quite hot and unusable for many applications. To reduce the temperature of the compressed air to a usable range, certain air compressor systems use water or air cooled aftercoolers—named thus because they are located downstream from the compressor. Aftercoolers cool the compressed air to temperatures lower than the dew point. Compressed air exiting an aftercooler will contain significant amounts of condensed water droplets suspended in the air stream.

FIG. 1 depicts a typical air cooled aftercooler 10 with an external moisture separator 12. An external moisture separator 12 may take up a considerable amount of space and add weight and cost to a system.

BRIEF SUMMARY OF THE INVENTION

With parenthetical reference to the corresponding parts, portions or surfaces of the disclosed embodiments, merely for purposes of illustration and not by way of limitation, the present invention provides a water separator and system (100) having a compressed air aftercooler (110, 210) with a water/moisture separator (112, 212).

In one aspect, a demister core (150, 250) comprising a plurality of offset fins (154) is provided. In another aspect, the invention provides an aftercooler for cooling compressed air, which aftercooler comprises a plurality of generally vertical compressed air paths and a plurality of corresponding aftercooler outlets at the bottom of the compressed air paths, wherein the compressed air paths are separated from each other by cooling air paths configured to convey cooling air, wherein the compressed air paths and cooling air paths are in heat exchange relationship with each other; and a water separator contiguous with the aftercooler outlets, which water separator comprises (a) a generally horizontal compartment directly beneath and in fluid communication with the aftercooler outlets and configured to accept compressed air discharged from the outlets, (b) a demister core downstream from and in fluid communication with the horizontal compartment, wherein the demister core comprises a plurality of fins configured to create an undulating flow through the demister core in order to separate water from compressed air, and (c) an exit compartment downstream from the demister core, which exit compartment has a compressed air outlet. In another aspect, the water separator includes a flow reduction region directly adjacent to and in fluid communication with the horizontal compartment, which flow reduction region has a greater cross-sectional area than the horizontal compartment, to reduce the horizontal velocity of compressed air passing therethrough. In another aspect, the cooling and water removal device and system includes an air compressor for providing compressed air to the aftercooler. In another aspect, the horizontal compartment or flow reduction region includes a generally vertical perforated plate extending upward from the bottom of the horizontal compartment or flow reduction region. In other aspects, the aftercooler is configured to receive compressed air at a temperature that is a minimum of about 80° Celsius and a maximum of about 140° Celsius. In yet another aspect, the aftercooler cools the temperature of compressed air to a minimum of 25° Celsius and a maximum of 45° Celsius. In another aspect, the demister core does not have a heat transfer passage and/or comprises pressed aluminum sheets arranged in an offset pattern and braised together.

Another aspect of the invention provides a cooling and water removal system having a cooling unit with multiple compartments: an aftercooler disposed within a first compartment; a horizontal air flow path disposed within a second compartment; a demister core disposed within a third compartment; and an exit compartment downstream from the demister core. In another aspect, an additional compartment, a flow reduction compartment, is included directly adjacent to the second compartment and in fluid communication with the horizontal air flow path, wherein the flow reduction compartment has a greater cross-sectional area than the second compartment, to reduce the horizontal velocity of the horizontal air flow.

In one aspect, a compressed air aftercooler comprises a compressed air core having one or more aftercooler inlets, aftercooler outlets and a first one or more heat transfer passages. In another aspect, the cooler core comprises one or more second heat transfer passages extending through the cooler core in heat exchange relationship with the one or more first heat transfer passages and configured to cool the compressed air in the first one or more heat transfer passages. In yet another aspect, the system comprises a moisture separator (112, 212) substantially integrally attached to the aftercooler outlet(s) (124, 224). In one embodiment, a first generally horizontal region or compartment is adjacent to the aftercooler outlet(s); and an expansion zone is provided which is adjacent to and in fluid communication with the first horizontal region. In such embodiment, the expansion zone is configured to reduce the horizontal velocity of compressed air passing therethrough.

Another aspect of the invention provides a demister core in fluid communication with the horizontal region and/or expansion zone. In certain aspects, the demister core comprises a plurality of offset fins creating an undulating flow through the demister core. Additionally, the system may include an exit zone downstream from the demister core, wherein the exit zone has an air outlet (e.g. at the top of the moisture separator) (116, 216) and a condensate drain (e.g. at the bottom of the moisture separator) (144, 244).

DESCRIPTION OF THE PREFERRED EMBODIMENTS

Figure 1:
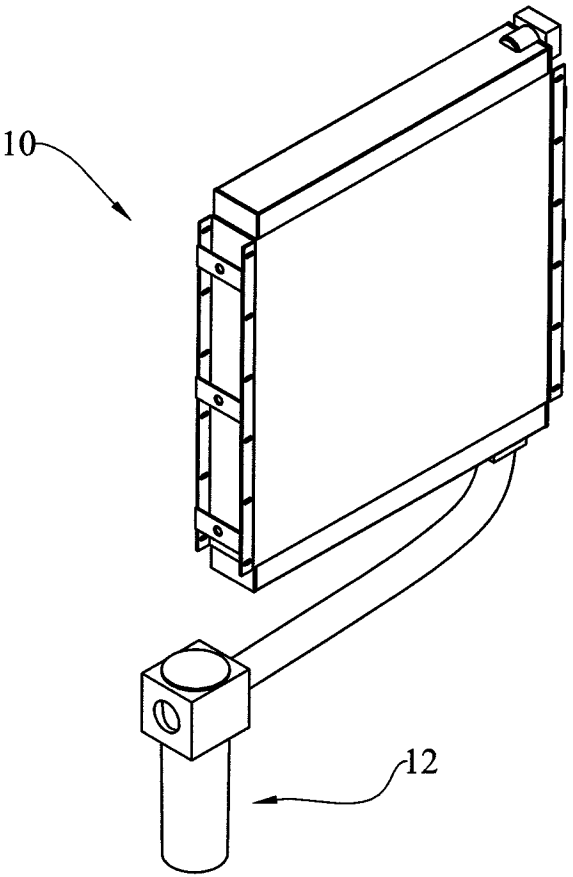
Fig. 1 (PRIOR ART)
FIG. 1 illustrates a prior art air cooled aftercooler with external moisture separator.

At the outset, it should be clearly understood that like reference numerals are intended to identify the same structural elements, portions or surfaces consistently throughout the several drawing figures, as such elements, portions or surfaces may be further described or explained by the entire written specification, of which this description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. The following description of the preferred embodiments of the present invention are examples and are not intended to restrict the scope of the present invention, the manner in which the various aspects of the invention may be implemented, or their applications or uses.

Figure 2:
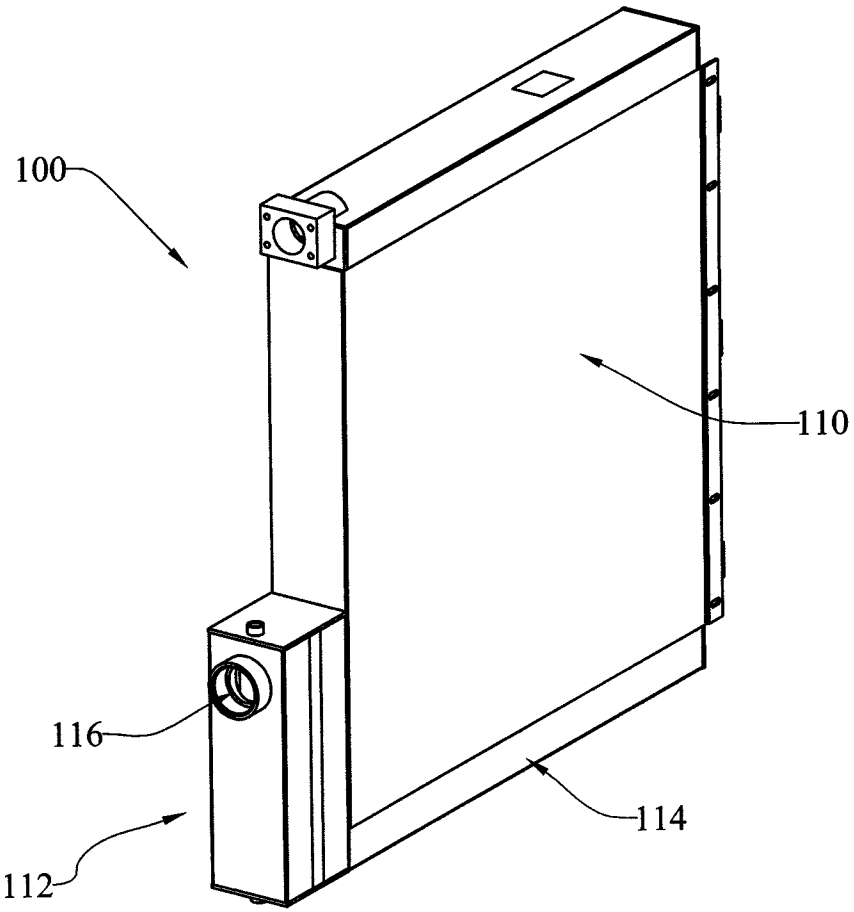
FIG. 2 illustrates an air cooled aftercooler with integral water separator of one embodiment of the invention.

FIG. 2 shows one embodiment of a cooling and water/moisture removal system 100 having an aftercooler 110 with a substantially integral water separator 112. The term "integral" as used herein includes, for example, a water separator attached or affixed to the aftercooler; or directly adjacent or contiguous to the aftercooler; or residing in, or fondling a portion of, the aftercooler or the housing containing the aftercooler, e.g. in a compartment within the aftercooler's housing. The embodiment illustrated in FIG. 2 reduces space, weight and/or cost requirements for water/moisture separation in an air cooled aftercooler 110 by incorporating a moisture separator 112 into an outlet manifold 114.

Figure 3:
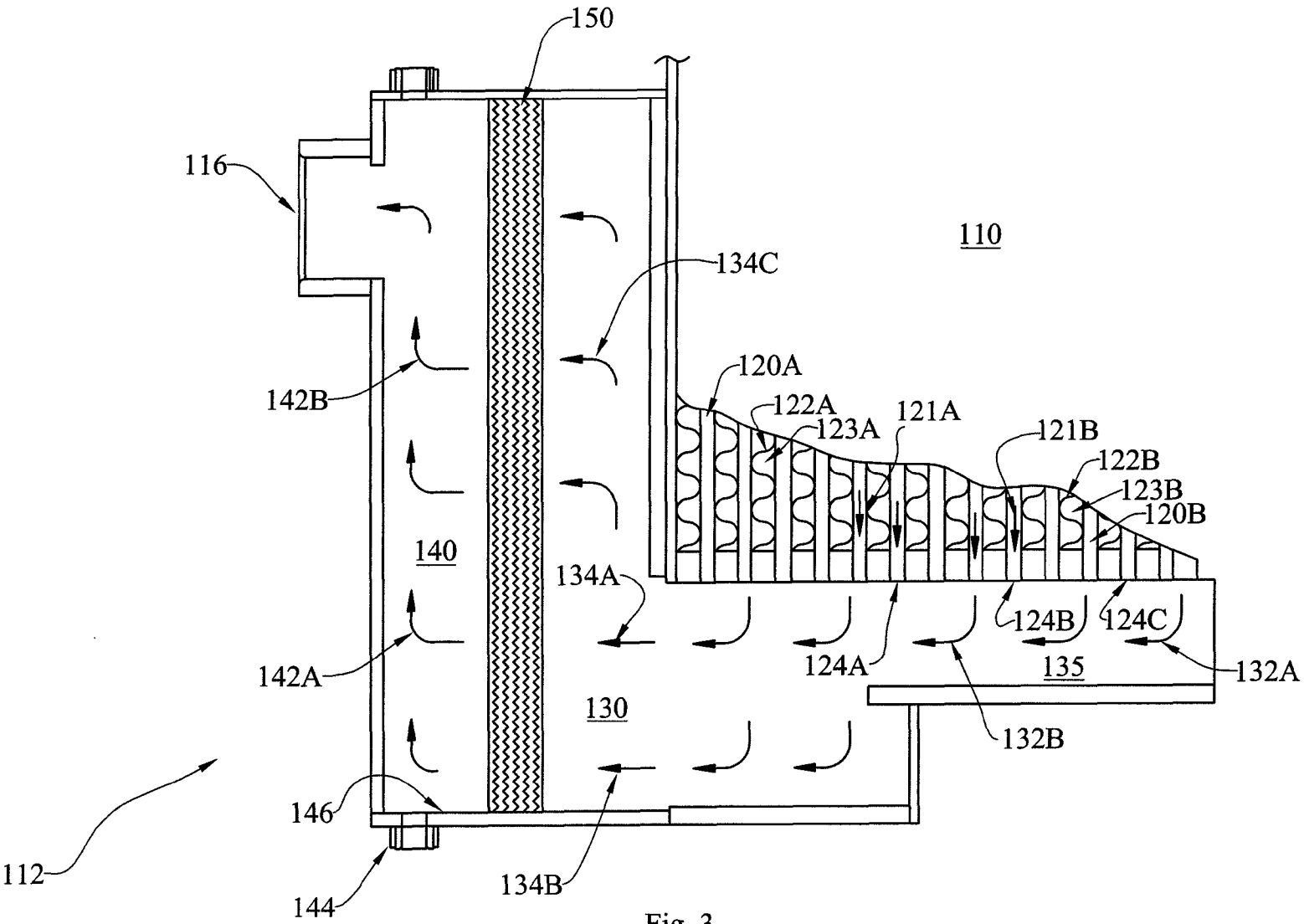
FIG. 3 is a sectional view of the water separator illustrated in FIG. 2.

With reference to FIG. 3, the aftercooler 110 has one or more cooling air passages e.g. 123A, 123B that pass between fins e.g. 122A, 122B. The cooling air passes between the fins through the aftercooler in a heat exchanging relationship from one face of the aftercooler to the opposite side. The air may be driven through the cooling air passages by a fan (not shown). The process air passes through multiple passages e.g. 120A, 120B along a vertical path as represented by direction arrows e.g. 121A, 121B.

In the embodiment illustrated in FIG. 3, moisture separation is achieved by channeling droplet laden air flow from the aftercooler outlets e.g. 124A, 124B, 124C into a generally horizontal compartment 135 beneath the aftercooler (and aftercooler outlets). The flow of droplet laden air in the horizontal compartment is generally indicated at 132A and 132B, for example. In one embodiment, horizontal velocity of the droplet laden air may be reduced by expanding the cross sectional area of the horizontal compartment into an expansion zone 130 as illustrated by direction arrows 134A and 134B. Other embodiments do not include an expansion zone; in such embodiments, horizontal velocity reduction is achieved at or near the face of the demister core.

Figure 4:
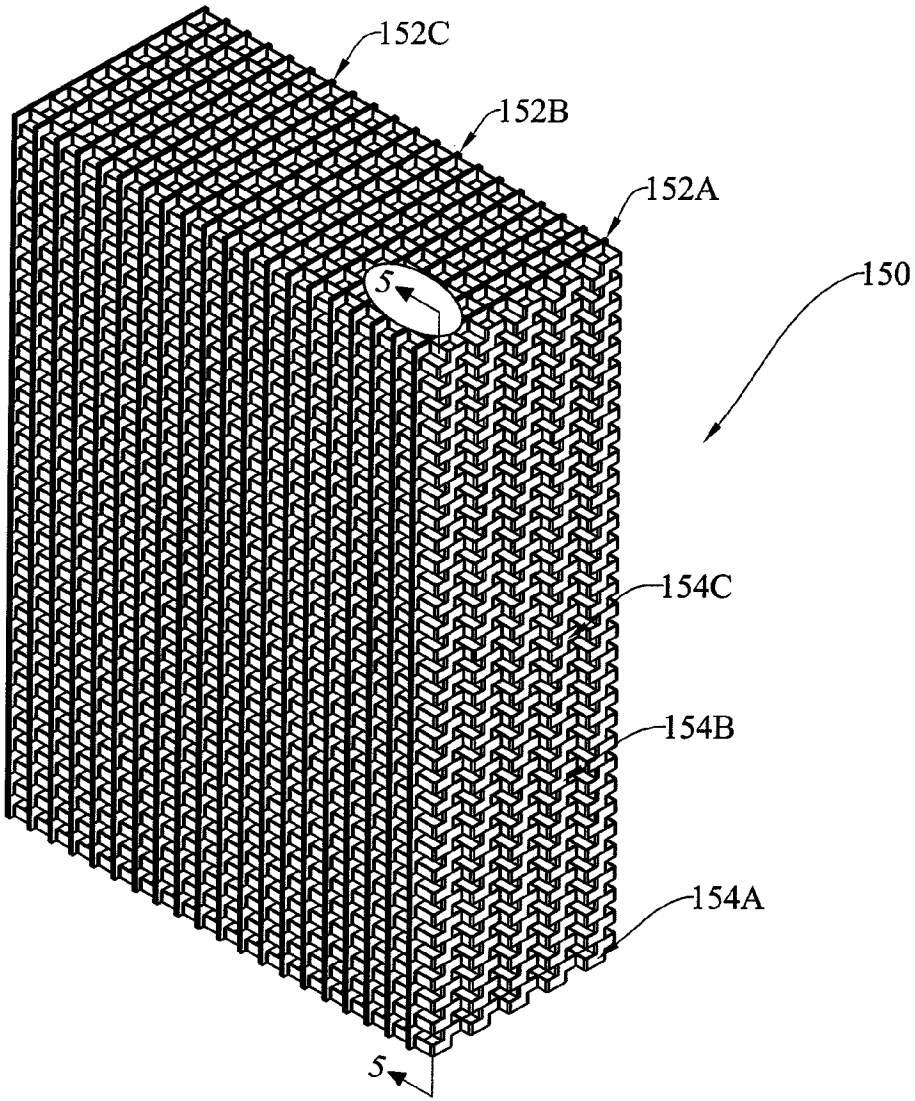
FIG. 4 illustrates a demister core of one embodiment of the present invention.
Figure 5:
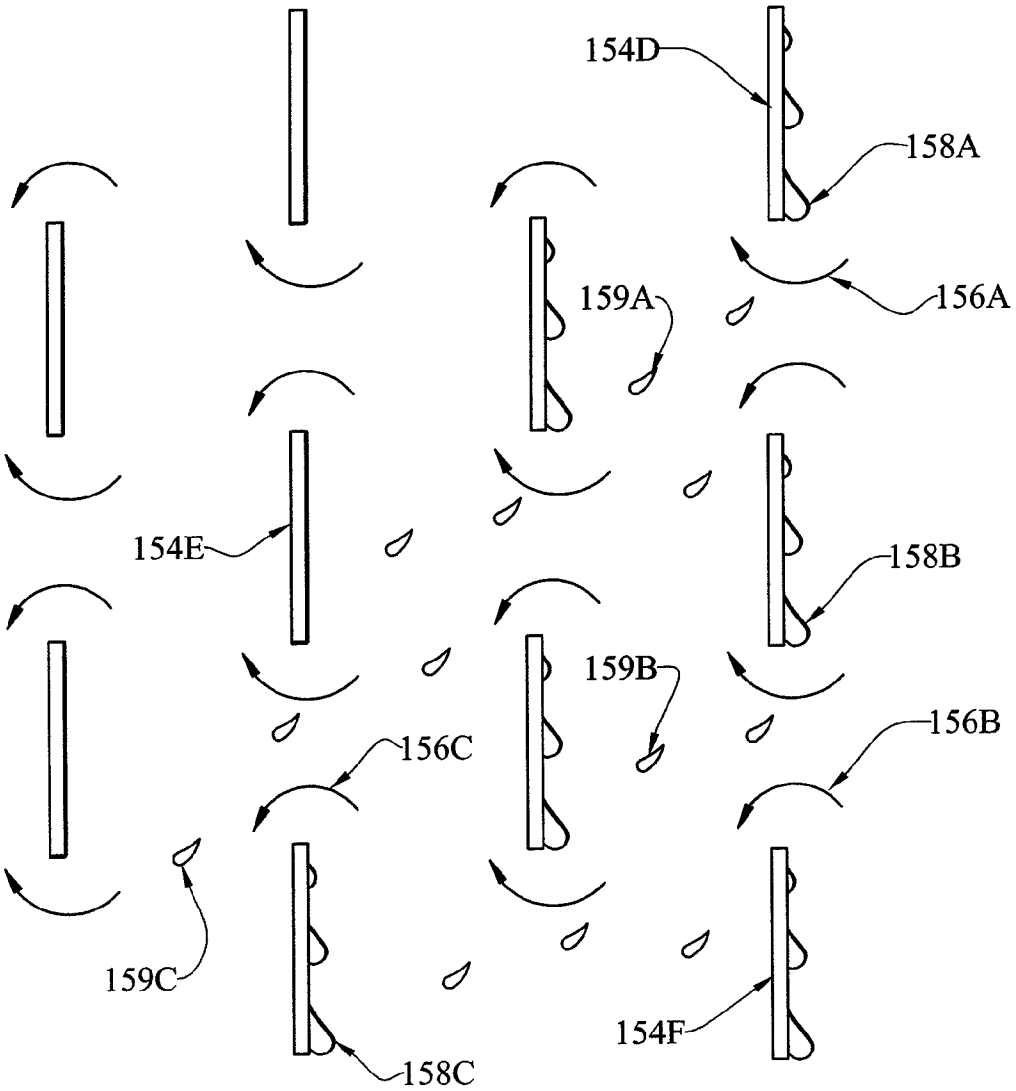
FIG. 5 is an enlarged sectional view of the demister core taken along the line 5-5.
Figure 7:
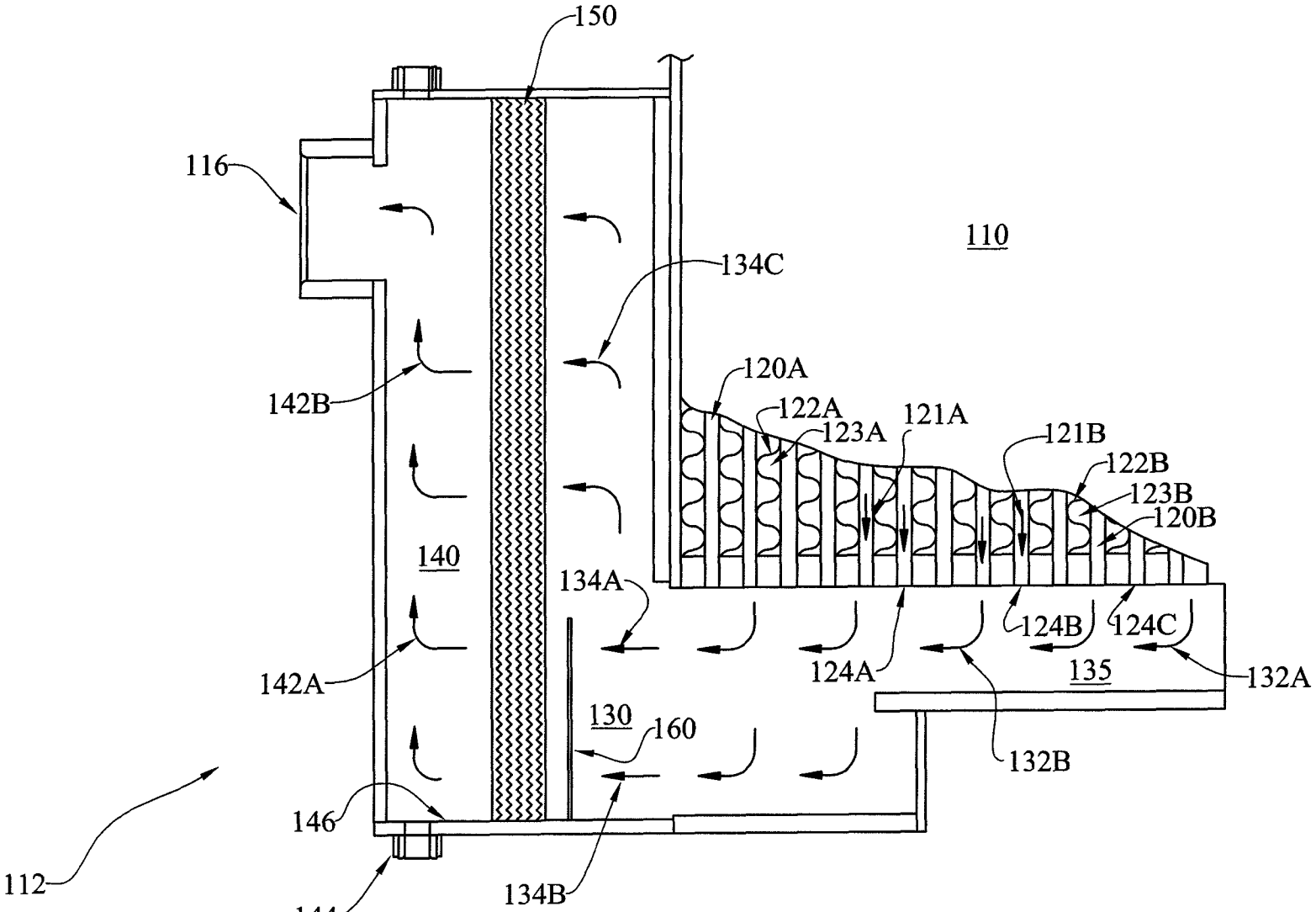
FIG. 7 illustrates an air cooled aftercooler with integral water separator of one embodiment of the invention, having a perforated plate.
Figure 8:
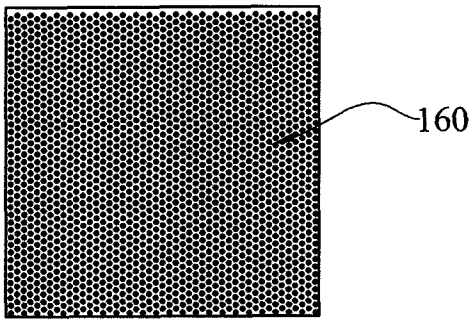
FIG. 8 is a front view of the perforated plate of FIG. 7.

Air is then directed through a vertically oriented vacuum brazed demister core or demister zone 150 that mechanically separates the droplets by forcing direction change in the air flow through the demister, causing coalescence of smaller air droplets into larger air droplets, and the advantageous use of gravity, as shown in FIGS. 3, 4 and 5. In one embodiment, a perforated plate 160 may be added, adjacent to the face of the demister core, to change the distribution of air flow across the face of the demister core (as illustrated in FIGS. 7 and 8). Air then passes from the demister core 150 into an exit zone 140 where it travels upward and out the air outlet 116 along path shown by direction arrows 142A, 142B, for example. Larger water particles are less likely to be carried by the slower moving air and drip to the collection pan 146 and are removed through the condensate drain 144 in this embodiment.

One aspect of this embodiment stems from the geometry of the demister core 150. The term "demister core" as used herein refers to an apparatus that provides a large surface area to volume ratio that is well suited to provide a contact surface for water droplets to contact and coalesce on, and is not adjacent to a heat exchanger. An example of the structure of a brazed demister core is disclosed in U.S. Pat. Nos. 5,845,505 and 6,085,529, incorporated herein by reference. The demister core 150 shown in the embodiment of FIG. 4 is made of individual sheets e.g. 152A, 152B, 152C of stamped aluminum, forming aluminum fins e.g. 154A, 154B, 154C. A plurality of stamped aluminum individual sheets are arranged so that the aluminum fins are offset, forming a matrix of offset rectangular aluminum fins e.g. 154A, 154B, 154C. Then when properly oriented, the individual sheets are brazed into the integral demister core 150 using the same production methods as those used for brazed aluminum bar and plate heat exchangers, such as air cooled oil coolers and compressed air aftercoolers, and other methods known to persons skilled in the art. The demister core 150 in this embodiment may be easily and inexpensively manufactured by aluminum bar and plate brazing technology. In this embodiment, fins are located where no heat transfer is occurring, i.e. there are no heat transfer/alternating coolant passages in the demister core. The brazed demister core is placed downstream of the heat exchanging aftercooler where it removes droplets from already cooled compressed air. In this aspect, the demister core operates as a separator only.

The flow of air from the compressor aftercooler outlets e.g. 124A, 124B, 124C is further described hereinbelow. Air flow from the aftercooler to the separator is directed by heat transfer passage(s) e.g. 120A, 120B to the aftercooler outlet(s) e.g. 124A, 124B at the bottom of the aftercooler. Saturated cooled air containing condensed moisture droplets (condensate) enters the horizontal inlet passage (or compartment) and travels in a generally horizontal pattern at a first horizontal velocity as shown by example direction arrows 132A, 132B. The horizontal speed of the air reduces as it passes from the horizontal inlet passage or compartment into an expansion zone 130 to a second horizontal velocity. After the horizontal velocity of the air and droplets is reduced, it passes through the demister core 150. The droplets coalesce on the demister core and drain downward into a separator collection pan 146 and are removed through the condensate drain 144. The air that has passed through the demister core into the exit zone 140 which does not drain downward travels upward and out the air outlet 116 as shown by direction arrows 142A, 142B.

As shown in FIG. 5, and with reference to FIGS. 3 and 4, the brazed demister core 150 separates moisture by causing the saturated air laden with entrained water particles e.g. 159A, 159B, 159C to move at a reduced horizontal velocity and pass through the offset fins e.g. 154D, 154E, 154F of the stacked aluminum sheets in an undulating and/or uneven path as shown by example direction arrows 156A, 156B, 156C. The slower moving condensate impinges on the fins and causes coalescence of the suspended droplets into larger water particles e.g. 158A, 158B, 158C.

Figure 6:
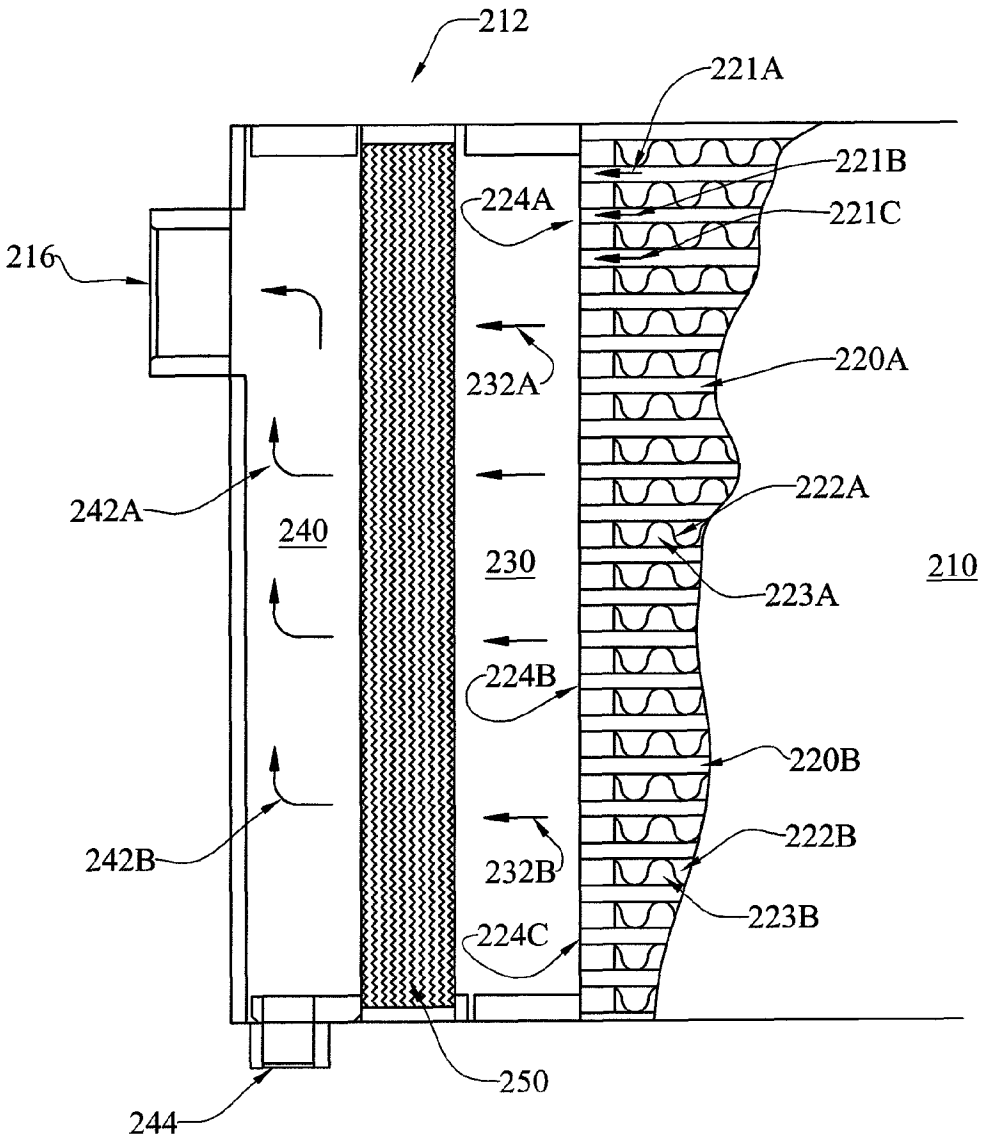
FIG. 6 is a sectional view of a water separator and aftercooler of one embodiment of the present invention.

Referring now to FIG. 6, an alternate embodiment of a cooling and water removal system having an aftercooler 210 with integral moisture separator 212 is illustrated. In this embodiment, the aftercooler 212 comprises one or more cooling air passages e.g. 223A, 223B that pass between fins e.g. 222A, 222B. The cooling air passes between the fins through cooling air passages in a heat exchanging relationship from one face of the aftercooler to the opposite side. The air may be driven through the cooling air passages by a fan (not shown). In this embodiment, the process air passes through multiple horizontal passages e.g. 220A, 220B along a horizontal path as represented by direction arrows e.g. 221A, 221B, 221C.

In this embodiment, moisture separation is achieved by channeling droplet laden air from the aftercooler outlet in such a way that its horizontal velocity is reduced by expanding the cross-sectional area of the multiple horizontal passages 220A, 220B directly into a compartment or expansion zone 230, as illustrated by example direction arrows 232A, 232B. Air is then directed through a vertically oriented vacuum brazed demister core 250 that mechanically separates the droplets by forcing direction change in the airflow through the demister core, causing coalescence of smaller air droplets into larger air droplets, and the advantageous use of gravity. The air then passes into an exit zone 240 where it travels upward and out the air outlet 216 along the path shown by direction arrows 242A, 242B. Water removed from the air collects at the bottom of the separator and is removed through a condensate drain 244.

FIG. 7 is an illustration of the embodiment of FIG. 3 with the addition of a perforated plate 160 adjacent to, flush or near the face of the demister core 150. A front view of the perforated plate 160 is illustrated in FIG. 8. In this illustration, the perforated plate is relatively thin compared to the demister core. The addition of perforated plate creates a better/more efficient distribution across the face of the demister core 150.

While there has been described what is believed to be the preferred embodiments of the present invention, those skilled in the art will recognize that other and further changes and modifications may be made thereto without departing from the spirit or scope of the invention. Therefore, the invention is not limited to the specific details and representative embodiments shown and described herein and may be embodied in other specific forms. The present embodiments are therefore to be considered as illustrative and not restrictive, the scope of the invention being indicated by the appended claims rather than by the foregoing description, and all changes, alternatives, modifications and embodiments which come within the meaning and range of the equivalency of the claims are therefore intended to be embraced therein. In addition, the terminology and phraseology used herein is for purposes of description and should not be regarded as limiting.

What is claimed is:

1. A cooling and water removal device, comprising:

an aftercooler for cooling compressed air, said aftercooler comprising a plurality of vertical compressed air paths and a plurality of corresponding aftercooler outlets at the bottoms of said compressed air paths; said compressed air paths separated from each other by cooling air paths configured to convey cooling air; said compressed air paths and said cooling air paths in heat exchange relationship with each other; and a water separator contiguous with said aftercooler outlets for removing water from compressed air discharged through said aftercooler outlets, said water separator comprising:

(a) a horizontal compartment directly beneath and in fluid communication with said aftercooler outlets, said horizontal compartment configured to accept compressed air discharged through said aftercooler outlets;

(b) a demister core downstream from and in fluid communication with said horizontal compartment, said demister core further comprising a plurality of offset, rectangular fins disposed perpendicular to a direction of fluid flow through the demister core to create an undulating flow through said demister core, thereby separating water from said compressed air, the plurality of offset, rectangular fins configured and arranged to define a continuous an upstream face and a continuous downstream face of the demister core, wherein fluid flows through the demister core in only one flow direction into the demister core through the a continuous upstream face and out of the demister core through the continuous downstream face;

(c) an exit compartment downstream from said demister core, said exit compartment having a compressed air outlet; and (d) wherein said demister core extends across the water separator such that the compressed air passes through the demister core before reaching the compressed air outlet.

2. The cooling and water removal device of claim 1, said water separator further comprising:

(d) a flow reduction region directly adjacent to and in fluid communication with said horizontal compartment, said flow reduction region having a greater cross-sectional area than said horizontal compartment to reduce the horizontal velocity of compressed air passing therethrough.

3. The cooling and water removal device of claim 2 wherein said flow reduction region comprises a vertical perforated plate extending upward from the bottom of said flow reduction region.

4. The cooling and water removal device of claim 1, further comprising an air compressor for providing compressed air to said aftercooler.

5. The cooling and water removal device of claim 1 wherein said water separator is formed integrally with said aftercooler.

6. The cooling and water removal device of claim 1 wherein said exit compartment comprises a water drain.

7. The cooling and water removal device of claim 1 wherein said horizontal compartment comprises a vertical perforated plate extending upward from the bottom of said horizontal compartment.

8. The cooling and water removal device of claim 1, wherein said aftercooler is configured to receive compressed air at a temperature that is a minimum of about 80 degrees Celsius and a maximum of about 140 degrees Celsius.

9. The cooling and water removal device of claim 1, wherein said aftercooler cools the temperature of said compressed air to a minimum of 25 degrees Celsius and a maximum of 45 degrees Celsius.

10. The cooling and water removal device of claim 1, wherein said demister core comprises pressed aluminum sheets arranged in an offset pattern and brazed together in a bar and plate configuration.

11. A cooling and water removal system, comprising: a cooling unit having multiple compartments, including an aftercooler disposed within a first compartment, said aftercooler comprising a compressed air core having a first heat transfer passage and an aftercooler outlet; and a cooler core having a second heat transfer passage in heat exchange relationship with said first heat transfer passage, said aftercooler configured and arranged to cool compressed air;

a horizontal air flow path disposed within a second compartment, said second compartment contiguous with and configured to accept compressed air discharged from said first compartment;

a demister core disposed within a third compartment, said third compartment in fluid communication with said second compartment, and said demister core comprising a plurality of offset, rectangular fins disposed perpendicular to a direction of fluid flow through the demister core for creating an undulating flow of compressed air through said demister core, the plurality of offset, rectangular fins configured and arranged to define an a continuous upstream face and a continuous downstream face of the demister core, wherein fluid flows through the demister core in a single flow direction into the continuous upstream face and out through the continuous downstream face of the demister core;

an exit compartment contiguous with said third compartment and downstream from said demister core, said exit compartment having a compressed air outlet;

and, wherein the demister core extends across the third compartment such that compressed air flows through the demister core before reaching the compressed air outlet.

12. The cooling and water removal system of claim 11, further comprising:

a flow reduction compartment directly adjacent to said second compartment and in fluid communication with said horizontal air flow path, said flow reduction compartment having a greater cross-sectional area than said second compartment to reduce the horizontal velocity of said horizontal air flow.

13. The cooling and water removal system of claim 11, further comprising an air compressor for providing compressed air to said aftercooler.

14. The cooling and water removal system of claim 11, wherein said aftercooler is configured to receive compressed air at a maximum pressure of 1400 KPa.

15. The cooling and water removal system of claim 11, wherein said compressed air passes through said aftercooler outlet at a first velocity, and subsequently passes through said demister core at a second, lower velocity of about 1 meter per second.

16. The cooling and water removal system of claim 11, wherein said demister core comprises pressed aluminum sheets arranged in an offset pattern and brazed together in a bar and plate configuration.

17. The cooling and water removal system of claim 11, wherein the temperature of said compressed air is reduced to a minimum of 25 degrees Celsius and a maximum of 45 degrees Celsius.

18. The cooling and water removal system of claim 11 wherein said exit compartment comprises a water drain.

19. The cooling and water removal system of claim 11 wherein said second compartment comprises a vertical perforated plate extending upward from the bottom of said second compartment, which perforated plate changes the distribution of air flow across the face of said demister core.

20. A cooling and water removal device, comprising:

an aftercooler for cooling compressed air, said aftercooler comprising a plurality of vertical compressed air paths and a plurality of corresponding aftercooler outlets at the bottoms of said compressed air paths; said compressed air paths separated from each other by cooling air paths configured to convey cooling air; said compressed air paths and said cooling air paths in heat exchange relationship with each other; and a water separator contiguous with said aftercooler outlets for removing water from compressed air discharged through said aftercooler outlets, said water separator comprising:

(a) a horizontal compartment directly beneath and in fluid communication with said aftercooler outlets, said horizontal compartment configured to accept compressed air discharged through said aftercooler outlets;

(b) a demister core downstream from and in fluid communication with said horizontal compartment, said demister core further comprising a plurality of fins configured to create an undulating flow through said demister core, thereby separating water from said compressed air, the plurality of fins configured and arranged to define an a continuous upstream face and a continuous downstream face of the demister core, wherein fluid flows through the demister core in a single flow direction into the demister core through the continuous upstream face and out of the demister core through the continuous downstream face;

(c) an exit compartment downstream from said demister core, said exit compartment having a compressed air outlet; and, (d) wherein said demister core extends across the water separator such that the compressed air passes through the demister core before reaching the compressed air outlet.

* * * * *